United States Patent [19]

Soto

[11] 4,177,919

[45] * Dec. 11, 1979

[54] DISPOSABLE, RESEALABLE CONTAINER

[76] Inventor: Ricardo H. Soto, Apartado 91711, Bogota, Colombia

[ * ] Notice: The portion of the term of this patent subsequent to Jul. 25, 1995, has been disclaimed.

[21] Appl. No.: 840,628

[22] Filed: Oct. 11, 1977

Related U.S. Application Data

[63] Continuation-in-part of Ser. No. 794,005, May 5, 1977, Pat. No. 4,102,487.

[51] Int. Cl.[2] ..... B65D 33/02; B65D 33/06; B65D 33/16

[52] U.S. Cl. ..... 229/54 R; 150/7; 150/25; 224/45 P; 224/52; 229/55; 229/62

[58] Field of Search ..... 229/54 R, 62, 55; 150/3, 7, 12, 25; 24/16 R, 17 A, 30.5 R; 224/45 BA, 45 H, 45 P, 52, 54

[56] References Cited

U.S. PATENT DOCUMENTS

| | | | |
|---|---|---|---|
| 1,876,231 | 9/1932 | Hume | 24/30.5 R |
| 2,309,315 | 1/1943 | Hirsch | 24/30.5 R |
| 2,643,424 | 6/1953 | Gothar | 24/17 A |
| 3,027,066 | 3/1962 | Vineberg | 229/54 R |
| 3,200,868 | 8/1965 | Strayer | 150/7 |
| 3,268,151 | 8/1966 | Soto | 229/62 |
| 3,299,927 | 1/1967 | Clarizio | 229/62 |

*Primary Examiner*—Stephen P. Garbe
*Attorney, Agent, or Firm*—Emrich, Root, O'Keeffe & Lee

[57] ABSTRACT

A sealable container includes a bag with front and back panels and side pleats. A carrier member is attached to the front panel of the bag adjacent to but spaced from an upper flap. The carrier provides a handle so that the bag may be held in one hand while items are placed in the bag with the other. The pleats are folded to close the bag, and the upper portion of the pleats and back panel may then be folded over the carrier to seal it. In one embodiment, a band is drawn about the folded upper portion and connected to the carrier to seal the bag. In other embodiments, the carrier or stiffener is removably attached to the bag so that it may be re-used. Either the carrier is provided with interconnecting sealing bands for sealing the bag, or it is slotted for engaging and sealing the top of the bag after it is folded over the carrier. The structure provides means for the use of a security seal to prevent re-entry into the secured bag without breaching the security seal.

13 Claims, 21 Drawing Figures

DISPOSABLE, RESEALABLE CONTAINER

RELATED APPLICATION

This is a continuation-in-part application of my copending application Ser. No. 794,005, filed May 5, 1977 now U.S. Pat. No. 4,102,487 for "Disposable Resealable Container".

BACKGROUND AND SUMMARY

The present invention relates to an inexpensive, yet sturdy container that may be used several times before discarding. Such containers are particularly suited for use by travelers or the like or by more expensive gift shops where the size of the container chosen depends upon the particular item being carried.

As such, the invention represents an improvement over the device disclosed in my U.S. Pat. No. 3,268,151, entitled "Bag Closure" which disclosed a flexible bag adapted to have its mouth folded and doubled through a flexible tubular closure having two separate passages arranged side-by-side. A first folded portion of the bag was positioned in one passage of the closure and the second folded portion was positioned in the other passage; and a fastener was extended through both folded portions and the tubular closure to hold the bag in a sealed condition. Thus, the closure member was a separate element, not ordinarily attached to the bag except for sealing.

In the present invention, a sealable container includes a bag having flat front and back panels and first and second pleated sides joined to the front and back panels. An elongated stiffener member or carrier is attached to the front panel a short distance beneath the mouth or opening of the bag. In one embodiment the carrier is attached by folding an upper flap of the front panel over the carrier and attaching it to the front panel along a glue line, or if thermoplastic materials are used, by heat sealing.

In this embodiment, the carrier is provided with a handle which extends through a die-cut in the folded portion. The carrier is long enough to extend beyond the front panel of the bag, and thereby defines first and second slotted extensions. The carrier is also provided with a central stud or protrusion with an enlarged head or button.

A flexible band or belt extends about the back panel and pleated sides of the bag and has ends fitted through the slots on the carrier extensions.

Thus, the bag may be held in one hand by the carrier while inserting items into it. The carrier acts to keep the bag supported and evenly distribute the weight of the contents of the bag to avoid tearing. Further, the carrier holds the mouth open to facilitate insertion of items. The band is dimensioned to permit the bag of the mouth to be fully opened, yet to restrain further opening of the bag which might cause tearing.

When items have been inserted into the bag, the pleated sides are folded to close the mouth of the bag, and the upper portion of the bag above the carrier is folded over the carrier to seal the bag. The free ends of the band are then drawn around the folded portion of the bag and attached to the beaded stud on the carrier to secure the bag. If it is desired, a slip of paper may be secured to the beaded stud prior to securing the free ends of the band, and after the free ends of the band are then secured to the beaded stud, the upper end of the paper may be sealed to itself, thereby enveloping the locked ends of the band and providing a seal which must be destroyed before the bag is re-opened. The seal may be replaced during subsequent usage.

In alternative embodiments the carrier is removably attached to the bag so that the carrier, which is an expensive part of the bag, can be re-used. In one such alternative embodiment, the carrier is attached to a folded upper flap of the front panel of the bag by means of studs projecting from the carrier. The carrier includes a bar which is laterally offset from its main body to provide a slot into which the edge of the folded flap of the front panel is placed and held. Further, in folding this embodiment, the pleats and back panel are folded over the carrier, placed into the slot and held by the studs. The carrier is simply removed from the bag by reversing the steps in sealing the bag.

In still another alternative embodiment, the carrier includes barbed appendages for securing the folded upper flap of the front panel; and a pair of sealing bands are provided integrally with the carrier. To seal this embodiment, the pleats and rear panel are folded over the carrier as before, and the sealing bands are passed through the pleats and the back panel and coupled together.

The present invention thus provides an inexpensive, resealable container that may be used several times before discarding. The same basic construction is amenable to the use of several different types of bag materials, such as heavy kraft paper, wax-coated paper, thin plastic or heavy-duty plastic, depending upon the desires of the manufacturer and the desired level of retail cost. The container, when sealed, is weatherproof to protect the contents against dust or rain. The container has many uses such as a sealed traveler's bag, (a broken seal indicating unauthorized entry), a shopping bag, a gift container, or, if insulating materials are used, an insulated, sealed container for hot or cold foods or the like. Another advantage of the present invention is that where it assumes a generally flat, low-volume position when not in use, it has a relatively large capacity when used to carry items. As indicated, depending upon the materials which are used, its ability to withstand wear and tearing is limited only by the materials which a manufacturer desires to incorporate into the container.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
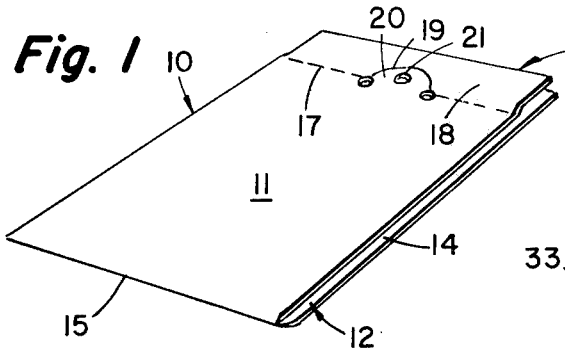
FIG. 1 is a perspective view of a folded bag prior to incorporation into a first embodiment of the present invention.
Figure 2:
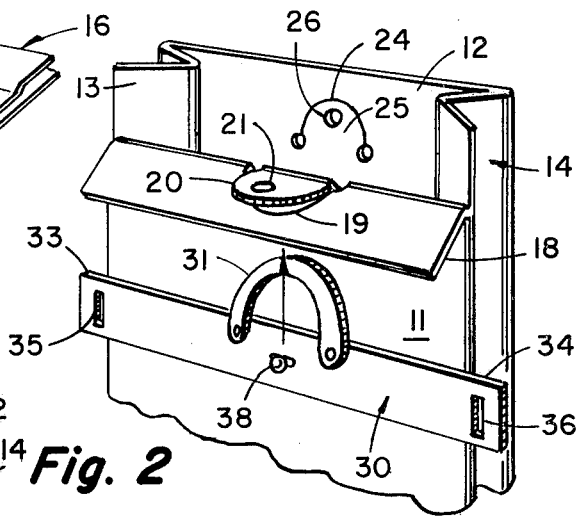
FIGS. 2–5 are fragmentary upper perspective views of the upper portion of the container illustrating the attachment of the carrier thereto.

Referring first to the embodiment of FIGS. 1-10, reference numeral 10 generally designates a flexible bag having generally flat front and back panels 11 and 12, together with first and second pleated sides 13 (see FIG. 2) and 14, and a bottom 15 formed by heat sealing the front and back panels together. This construction provides a flat bottom when the bag is filled. The bag is closed except for an open top generally designated 16. The upper portion of the front panel 11 (that is, the portion above the dashed line 17) is cut free at its edges to form a flap designated 18. The flap is foldable since its edges are not secured to the associated portions of the pleated sides 13, 14, as best illustrated in FIG. 2. A die-cut 19 of semi-circular shape is formed in the flap 18, and the lower portions of the die-cut are formed into round apertures to prevent further tearing. The die-cut 19 forms a tab 20, at the center of which there is provided an aperture 21, the function of which will be further discussed presently.

Referring now to FIG. 2, a similar semi-circular die-cut 24 is formed on the back panel 12 in register with the die-cut 19 to define a tab 25 which is apertured at 26.

A stiffener member or carrier generally designated 30 is in the form of an elongated, generally flat element; and it includes a handle 31 which may be riveted or otherwise attached to the carrier 30. The length of the carrier element 30 is such as to extend beyond both edges of the front panel 11 of the bag, thereby defining first and second extensions 33, 34. These extensions are slotted respectively at 35, 36, which slots are also located beyond the edges of the front panel 11. At the center of the carrier 30 there is a stud 38 having a rounded head or bead which is adapted to fit through the apertures 21, 26 in a manner to be disclosed presently.

Figure 4:
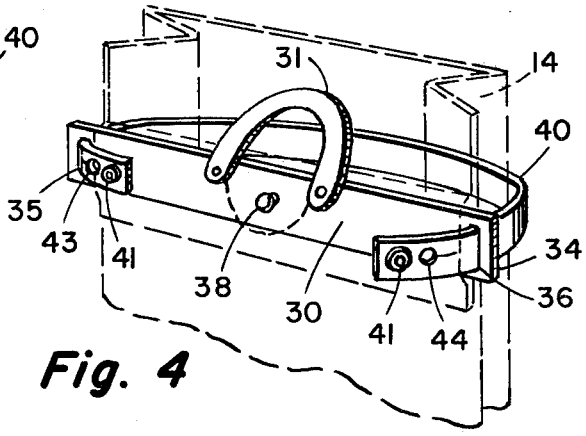
Figure 5:
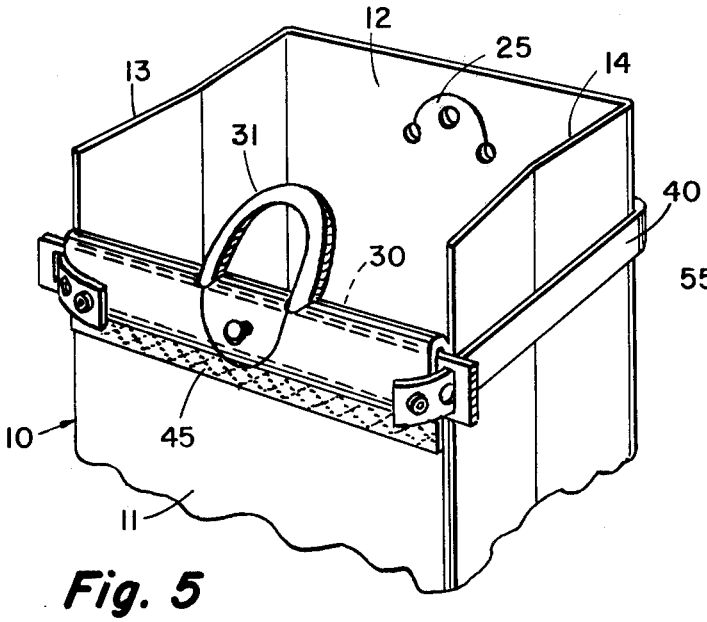

Referring now to FIGS. 4 and 5, a flexible band or belt generally designated 40 extends around the mouth 16 of the bag, and in cooperation with the carrier member 30 completely encompasses the mouth of the bag. The free ends of the band 40 are fitted through the slots 35, 36 in the extensions of the stiffener member. Each end of the band 40 is provided with protrusions 41 which retain the ends of the band in the slots and prevent their accidental withdrawal. Further, the ends of the band are apertured at 43 and 44 respectively.

Figure 3:
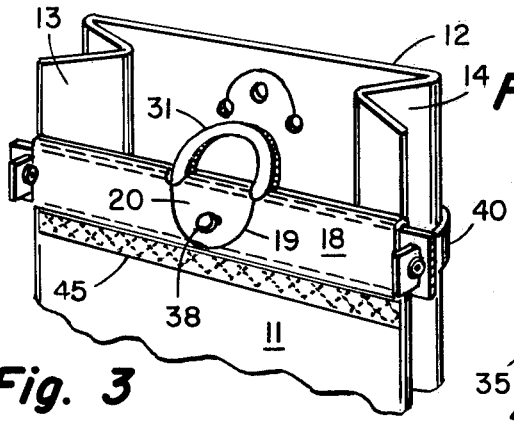

Referring now to FIGS. 2 and 3, the carrier 30 is assembled to the bag by inserting it in the direction of the arrow shown in FIG. 2 so that the handle 31 extends through the die-cut 19 in the flap 18. The lower ends of the handle 31 are thus received in the circular apertures at the lower ends of the die-cut 19, as best seen in FIG. 3; and the flap 18 is folded over the carrier. The flap 18 is long enough to extend beneath the carrier; and in the first embodiment, it is secured to the front panel 11 by gluing along the marginal edge as at 45 in FIG. 3. The aperture 21 of the tab 20 is then fitted over the beaded stud 38 on the stiffener member. Thus, the carrier 30 is attached to the front panel of the bag comprising the upper portions of the pleats 13, 14 and the rear panel 12.

As best illustrated in FIG. 5, in order to place items in the container, it may be held by the handle 31 so that the carrier 30 acts to stiffen the upper portion of the front panel 11 and thereby hold the mouth of the bag opened while the band 40 may be sized to limit the extent of the opening and thereby prevent tearing of the bag. As will be better understood from a complete description of the invention, the carrier 30 further acts to completely stiffen the top of the bag after it is sealed and secured, for transporting or carrying the container. The carrier also distributes the weight of the contents of the bag over an elongated portion of the bag, and this facilitates carrying heavier items whether the bag is opened or closed.

Figure 6:
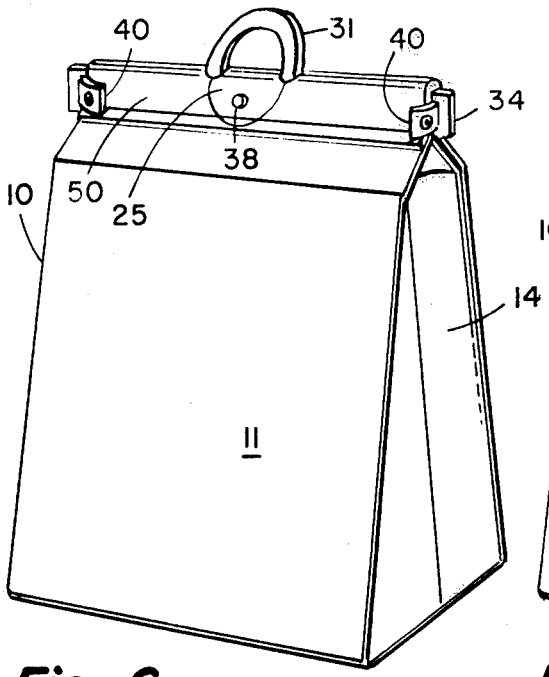
FIGS. 6–9 are upper perspective views of the assembled container of FIG. 5 showing closing, sealing and securing in the use position.
Figure 7:
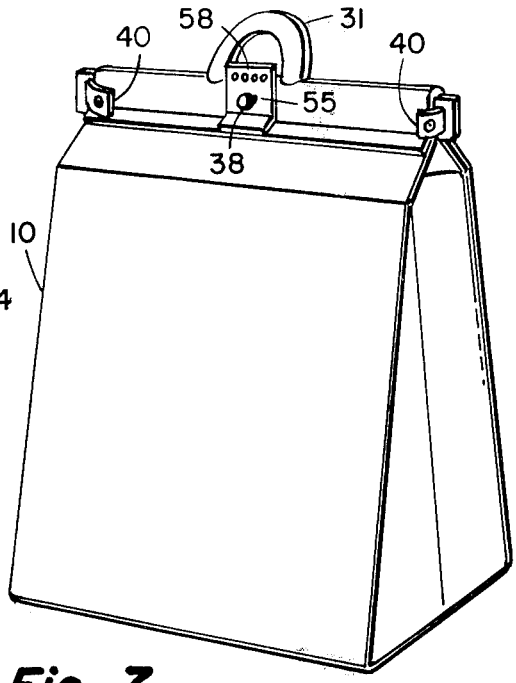

Referring now to FIG. 6, after the contents are placed in the container, the upper foldable portion of the bag just described is folded over the top of the carrier 30, as at 50 in FIG. 6, with the handle 31 extending through the die-cut 24, and the tab 25 on the back panel 12 placed beneath the handle 31 and over the beaded stud 38. Thus, the container is closed.

Figure 10:
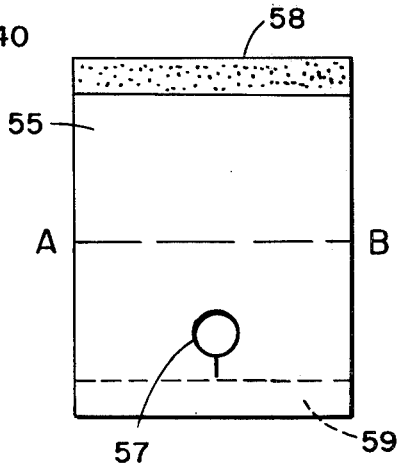
FIG. 10 is an elevational view of a seal which may be used to detect unauthorized entry into the container of FIG. 5.

If it is desired to place a seal on the container, a seal such as a piece of paper shown at 55 in FIG. 10 with an aperture 57 may be used. One marginal edge of the seal 55 is provided with an adhesive as at 58, adapted to be placed adjacent and secured to the opposing marginal edge 59 when the seal 55 is folded along the dashed line A-B. The seal 55 is placed over the beaded stud 38 by means of the aperture 57 so that the glue line 58 extends above the carrier 30.

Figure 8:
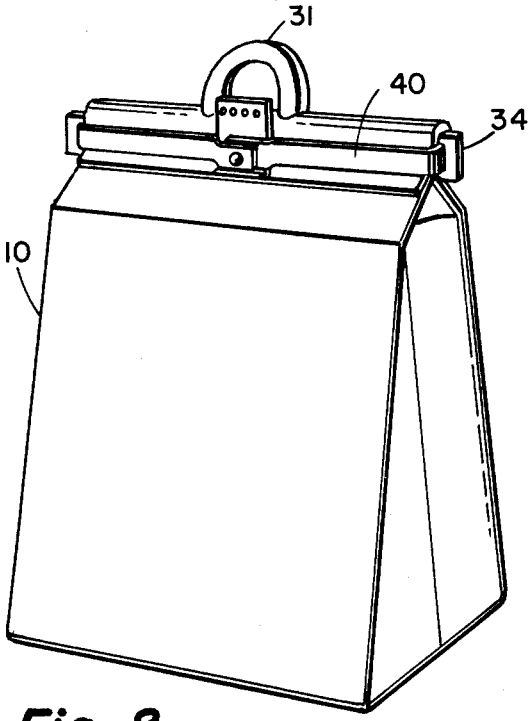
Figure 9:
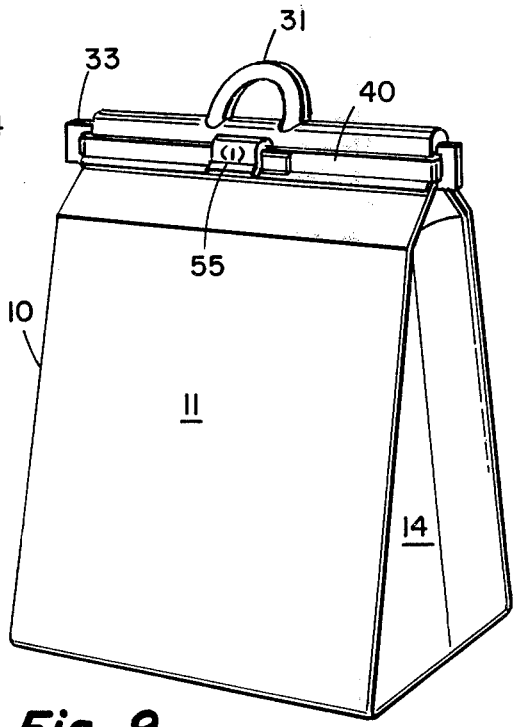
Figure 11:
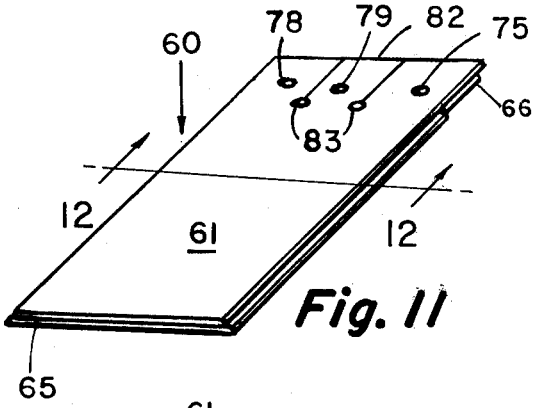
FIG. 11 is a perspective view of a bag used in a second embodiment.

Next, the band 40 is drawn about the folded upper portion of the bag and both ends of the band 40 are attached to the stud 38 by means of the apertures 43, 44, as seen in FIG. 8. This seals the container after it is closed. Finally, the security seal 55 is folded and glued together as seen in FIG. 9 so that the bag cannot be opened without breaking the security seal and thereby render the unauthorized opening easily detectable. In this position, the handle 31 is readily accessible, there are no loose ends in the container, and it is completely closed, sealed and secured.

Figure 12:
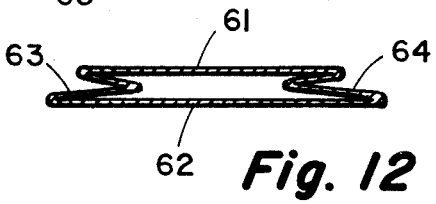
FIG. 12 is a cross sectional view of the bag of FIG. 11 taken through the sight line 12—12.

Turning now to the embodiment of FIGS. 11-16, the bag is generally designated by reference numeral 60, and it includes first and second panels 61 and 62, first and second pleated sides 63, 64, and a closed bottom 65. A foldable flap 66 is formed in the upper portion of panel 62 by cutting the edges at 66A and 66B (see FIG. 14) to be free of the pleats. As best seen in FIG. 12, the lateral extension of the panel 62 is somewhat less than the lateral extension of the back panel 61 on both sides of the bag. This is not necessary for the operation of the invention, but it is believed that it will facilitate various manufacturing operations, such as one-step forming of the various perforations and die-cuts to be described.

Figure 14:
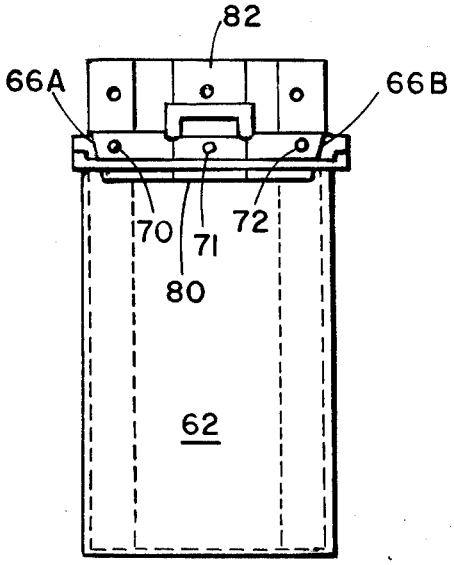
FIG. 14 is a frontal view showing the carrier attached to the bag of the embodiment of FIG. 11.

Three holes are formed in the flap 66; and these are designated respectively 70, 71 and 72 in FIG. 14. They are formed along a line parallel to the top edge of panel 62, but again, this is not necessary for the practice of the invention. The holes 70, 72 are spaced toward the respective edges of the bag so that similar holes are formed in the same operation in the side pleat 63, 64, as well as in panel 61. Thus, the holes in register with the hole 70 are designated 73, 74 and 75 in FIG. 15. Similarly, the holes in register with the hole 72 are designated 76, 77 and 78. A hole designated 79 in FIG. 15 on the panel 61 is also formed in register with the corresponding hole 71 on the flap 66.

A die-cut tab 80 is formed by two parallel slits located to either side of the aperture 71 on the panel 62, and a similar die-cut tab 82 is formed adjacent the aperture 79 on the panel 61 of the bag, by the same die. Stress-reducing apertures 83 are formed at the ends of the die-cut tab 80 to receive a handle; and similar apertures 84 are formed at the end of the die-cut tab 82.

Figure 13:
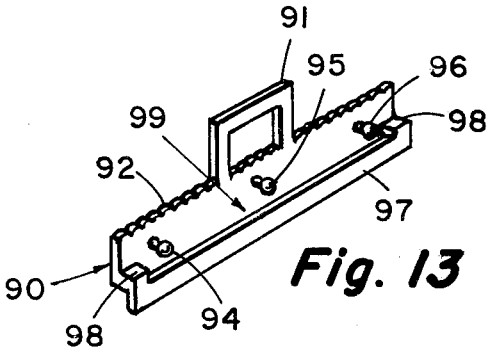
FIG. 13 is an upper perspective view of a carrier for the embodiment of FIG. 11.

Turning now to FIG. 13, a carrier is generally designated by reference numeral 90, and it includes an upper handle 91, a scalloped upper edge 92, three beaded studs 94, 95 and 96, and an elongated bar 97. The bar 97 is spaced outwardly from the body of the carrier 90 by means of projections 98 integrally formed therewith to define a slot 99.

Figure 15:
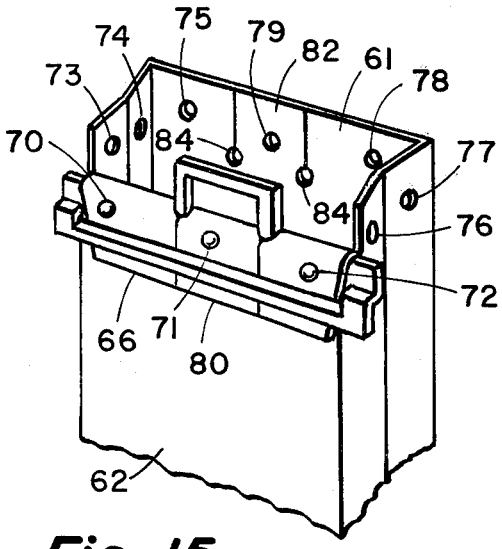
FIG. 15 is an upper perspective view showing the bag of FIG. 11 in the open position with carrier attached, and with the lower portion of the bag broken away for brevity.

Referring now to FIGS. 14 and 15, the carrier 90 is assembled to the panel 62 of the bag by passing the tab 80 beneath handle 91 of the carrier so that the base ends of the handle are received in the aperture 83. The aperture 71 is passed over the central beaded stud 95 on the carrier. The side portions of the flap 66 (partially freed by the cut forming tab 80) are individually attached to the carrier 90 by assembling apertures 70 and 72 to beaded studs 94 and 96 respectively. The edges 66A and 66B of flap 66 may be beveled to facilitate passing it through the slot 99, and under the bar 97 of the carrier.

With a carrier thus assembled to the upper folded flap of one panel of the bag, there is no need to glue the edge of the flap to the panel. Thus, the carrier 90 may be removed from the front panel by reversing the steps just described so as to permit it to be re-used.

Figure 16:
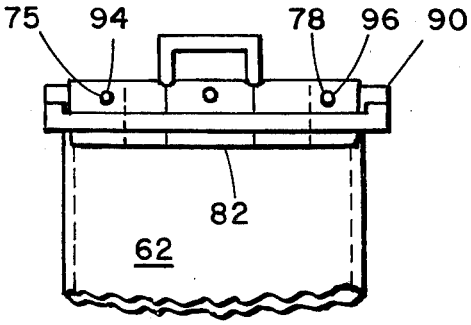
FIG. 16 is a frontal fragmentary view of the structure of FIG. 15 with the bag sealed.

When thus assembled to the bag, the carrier provides the same functions as disclosed in the earlier embodiment. Referring now to FIG. 16, when it is desired to seal the bag, the gussets 63, 64 are folded to close the bag, the tab 82 is passed through the handle 91 and secured to the center stud 95 on the carrier by passing the aperture 79 over it. The folded portion of the gussets and the top portions of panel 61 are then tucked into the slot 99 beneath the bar 97 on the carrier 90 and assembled to beaded studs 94, 96.

Turning to the embodiment of FIGS. 17–21, this embodiment is also designed so that the carrier may be removed from the bag and re-used. Referring now to the drawing, reference numeral 120 designates a bag, and it may be formed in a manner similar to the previously disclosed bag 60, including front panel 121, rear panel 122, first and second pleated sides 123, 124, and a closed bottom 125. Further, die-cuts are provided in a flap 128 of the front panel to define a tab 126, and in the rear panel to define a tab 127. A series of three laterally lined apertures 130, 131 and 132 are formed completely through the bag, with the side apertures passing through the pleats. Similarly, a series of three upper apertures are formed, 133, 134, and 135. For each of these apertures formed on the front panel of the bag, corresponding apertures in the gussets and rear panel are designated by the same reference numeral followed by a letter. For example, corresponding to the front aperture 130, apertures 130A and 130B are formed in the pleat or gusset 123, and an aperture 130C is formed in the rear panel.

Figure 18:
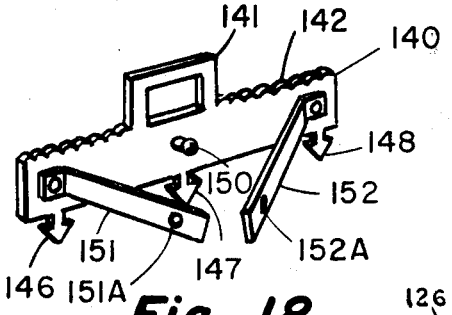
FIG. 18 is a perspective view of a carrier for use with the bag of FIG. 17.
Figure 17:
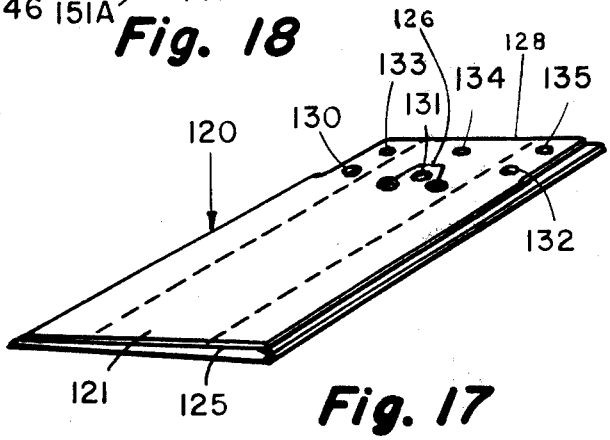
FIG. 17 is a perspective view of a bag for use in a third embodiment.
Figure 20:
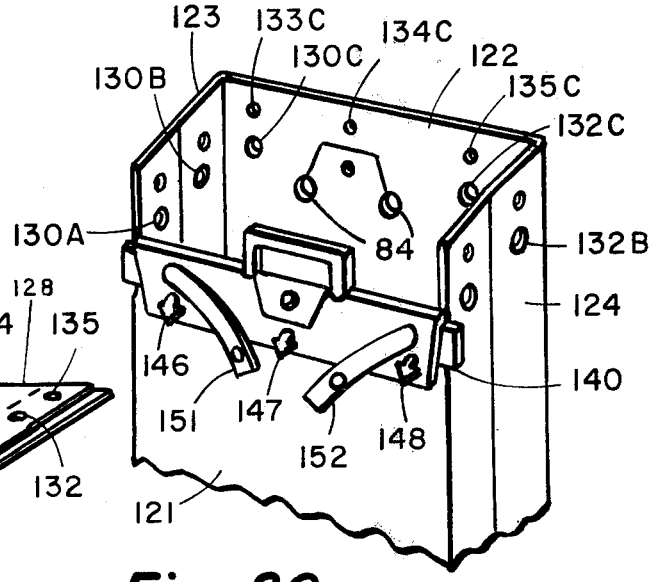
FIG. 20 is a fragmentary upper perspective view of the structure of FIG. 19 with the bag opened.

Turning now to FIG. 18, the carrier is generally designated by reference numeral 140, and it includes a handle 141 and an upper scalloped edge 142 for enhancing frictional contact with the folded portion of the front panel 120 in assembling it to the front panel. The carrier 140 includes three barbed appendages 146, 147 and 148 which are used to assemble the carrier to the folded upper portion of the front panel, as seen in FIG. 20, by passing the appendages respectively through the upper line of apertures 133, 134 and 135. The carrier 140 also includes a beaded stud 150 and a pair of side bands 151 and 152 which are apertured respectively at 151A and 152A for fitting over the stud 150, as will be described. The bands 151, 152 are passed through the apertures 130, 132 when the carrier 140 is assembled to the bag. The flap 126 is passed beneath the handle and secured to the stud 150.

Figure 19:
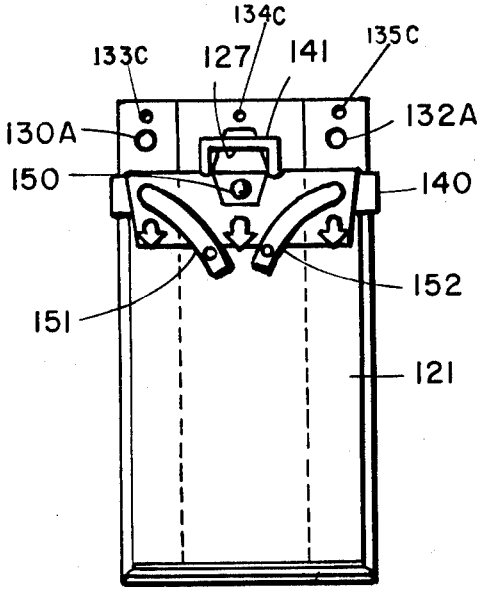
FIG. 19 is a frontal view showing the bag and carrier of FIGS. 17 and 18 respectively in assembled relation.

The carrier is fully assembled to the front panel of the bag as seen in FIGS. 19 and 20.

Figure 21:
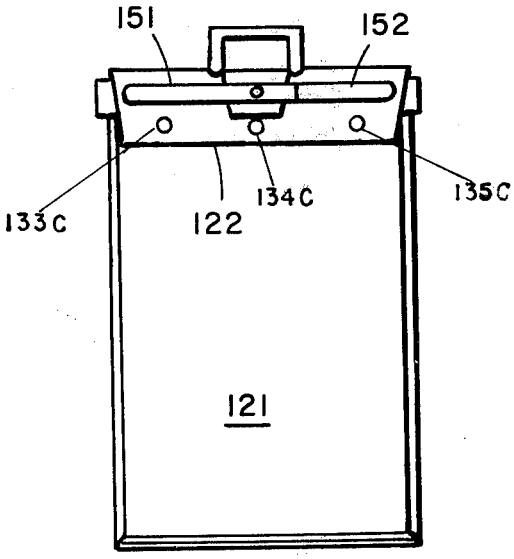
FIG. 21 is a frontal view of the structure of FIG. 19 with the bag sealed.

In order to seal the bag, as seen in FIG. 21, the pleats are closed, the tab 127 in the back panel is passed beneath the handle 141 and secured to the stud 150 on the carrier 140. The band 151 is passed through the apertures 130A, 130B and 130C. Similarly, the band 152 is passed through the apertures 132A and 132B and 132C. The bands are then secured to the stud 150 on the carrier; and the bands thereby hold the upper portion of the pleats and back panel in the sealed, folded position. The bag may be reopened by reversing the closure steps just mentioned, and the carrier 140 may be removed by dislodging the barbed appendages 146–148, by moving the tab 126 off the stud 150 and removing the bands 151, 152. Thus, the most expensive part of the bag may be reused. As indicated, a wide range of materials may be used for the various elements disclosed, depending upon the intended use.

Having thus disclosed in detail a number of preferred embodiments of the invention, persons skilled in the art will be able to modify certain of the structure which has been illustrated, or to substitute equivalent elements for those disclosed while continuing to practice the principle of the invention; and it is, therefore, intended that all such modifications and substitutions be covered as they are embraced within the spirit and scope of the appended claims.

I claim:

1. A sealable container comprising a bag having generally flat first and second panels and first and second pleated sides joining said panels together and cooperating therewith to define an open mouth, the upper portion of said first panel having its side edges separated from said pleated sides to define a foldable flap; an elongated, generally flat carrier providing a handle and held by said first panel and having an upper edge spaced from said mouth beneath said flap, said flap being folded against said edge and securing said carrier to said bag; means for attaching said folded flap to one of said carrier and first panel, whereby said carrier provides support to said bag and its contents when the bag is open; and lock means on said carrier for securing the upper portions of said pleats and said second panel to said carrier after they have been closed and folded over said upper edge of said carrier.

2. The apparatus of claim 1 wherein said carrier includes first and second extensions extending laterally beyond said first panel, each extension defining a slot, said container further including a flexible band extending about said second panel and said pleated sides and having its ends extending through said slots of said carrier extensions, whereby the free ends of said band may be drawn around the folded upper portion of said bag to secure the same in a closed position.

3. The container of claim 1 wherein said flap defines a die-cut tab extending through said handle and secured to said lock means of said carrier.

4. The apparatus of claim 3 wherein said second panel is die-cut to define a tab extending through said handle when the upper portion of said second panel is folded over said edge of said carrier, said tab on said second panel extending beneath said handle and secured to said lock means on said carrier for sealing said bag.

5. The apparatus of claim 4 wherein said lock means comprises a beaded stud projecting laterally of said carrier.

6. The apparatus of claim 1 further comprising a foldable security seal adapted to be attached to said lock means before said band is drawn, and adapted to be sealed to itself after said band is drawn and connected to said lock means, thereby preventing re-entry into the secured bag without breaching said security seal.

7. The container of claim 6 wherein said bag includes a mouth partially defined by said foldable flap, a tab cut in said flap and having an opening at each end of said cut for receiving said handle; and die-cut apertures in register with said lock means of said carrier and said security seal.

8. A sealable container comprising a bag having generally flat first and second panels and first and second pleated sides joining said panels together and cooperating therewith to define an open mouth, the upper portion of one of said panels having its side edges separated from said pleated sides to define a foldable flap; an elongated, generally flat carrier providing a handle, said carrier defining an upper edge spaced from said mouth beneath said foldable flap when said carrier is assembled to said bag whereby said carrier provides support to said bag and its contents when the bag is open; means for releasably securing said flap to said carrier after said flap is folded over said edge; and lock means for securing the upper portions of said pleats and said other panel to said carrier after they have been closed and folded over the upper edge of said carrier.

9. The container of claim 8 wherein said carrier includes a plurality of beaded studs extending laterally thereof, and including a generally flat body portion and an elongated bar spaced from said body portion to define a slot, said flap of said first panel defining apertures for engaging said beaded studs, the distal end of said flap extending through said slot, said pleats and rear panel further defining apertures for fitting over said beaded studs when said bag is sealed, said pleats and second panel being further adapted to fit through said slot.

10. The container of claim 8 wherein said carrier includes a plurality of barbed appendages extending therefrom and adapted to be placed through corresponding apertures on said flap after said flap is folded over the upper edge of said carrier, said flap defining a tab extending through the handle of said carrier and fitted over one of said beaded studs, said carrier further including first and second bands adapted to extend through respective registered apertures in said flap, said pleats and said second panel to secure the folded top portion of said bag against said carrier.

11. The container of claim 10 wherein said bands are coupled to at least one of said beaded studs on said carrier when said bag is sealed.

12. The container of claim 8 wherein said upper edge of said carrier is scalloped to improve the frictional engagement between said flap and said carrier.

13. The apparatus of claim 8 wherein said first panel extends beyond each lateral edge of said second panel.

* * * * *